US007458213B2

(12) United States Patent
Coppendale et al.

(10) Patent No.: US 7,458,213 B2
(45) Date of Patent: Dec. 2, 2008

(54) HEATING ARRANGEMENT

(75) Inventors: John Coppendale, Stapleford (GB); Stephen Michael Hasko, Huntingdon (GB)

(73) Assignee: Microgen Energy Limited, Reading (GB)

( * ) Notice: Subject to any disclaimer, the term of this patent is extended or adjusted under 35 U.S.C. 154(b) by 171 days.

(21) Appl. No.: 10/556,411

(22) PCT Filed: May 12, 2004

(86) PCT No.: PCT/GB2004/002061

§ 371 (c)(1),
(2), (4) Date: Jan. 23, 2006

(87) PCT Pub. No.: WO2004/102081

PCT Pub. Date: Nov. 25, 2004

(65) Prior Publication Data

US 2007/0028864 A1 Feb. 8, 2007

(30) Foreign Application Priority Data

May 13, 2003 (GB) ..... 0311002.0

(51) Int. Cl.
*F01B 29/10* (2006.01)

(52) U.S. Cl. ..... 60/524; 60/517

(58) Field of Classification Search ..... 60/517, 60/518, 519, 520, 524, 526
See application file for complete search history.

(56) References Cited

U.S. PATENT DOCUMENTS

| | | | | |
|---|---|---|---|---|
| 4,984,428 | A * | 1/1991 | Momose et al. | 60/517 |
| 6,311,491 | B1 * | 11/2001 | Conrad | 60/520 |
| 6,935,108 | B2 * | 8/2005 | Aldridge et al. | 60/524 |

FOREIGN PATENT DOCUMENTS

| | | |
|---|---|---|
| DE | 101 12 671 | 10/2002 |
| EP | 0 582 109 | 2/1994 |
| EP | 1 083 393 | 3/1994 |
| EP | 1 278 025 | 1/2003 |
| WO | WO2003/033961 | 4/2003 |

* cited by examiner

*Primary Examiner*—Hoang M Nguyen
(74) *Attorney, Agent, or Firm*—Ballard Spahr Andrews & Ingersoll, LLP

(57) ABSTRACT

A heating arrangement for heating a fluid, the arrangement comprising an elongate housing having a main axis. An inner chamber (21) for a first fluid surrounds the axis. A plurality of axially extending fins (22) project into the inner chamber. An exhaust gas inlet which receives exhaust gas, for example, from a Stirling engine, is provided at one end of the inner chamber. A supplementary burner (20) at the opposite end of the chamber is arranged to fire radially outwardly on to the fins. An outer chamber (30) for a second fluid surrounds the inner chamber.

9 Claims, 3 Drawing Sheets

HEATING ARRANGEMENT

CROSS REFERENCE TO RELATED APPLICATIONS

The present application claims priority to Great Britain Patent Application No. 0311002.0, filed May 13, 2003, which application is incorporated herein fully by this reference.

The present invention relates to a heating arrangement for heating a fluid. In particular, the invention relates to a heating arrangement which can be used with a Stirling engine in a domestic combined heat and power (DCHP) system.

The system currently contemplated by the applicant has a gas fired linear-free piston Stirling engine which generates electrical power and heat. Some of the heat rejected by the Stirling engine is recovered and is used to provide some of the domestic heat demand. However, the amount of heat produced by the Stirling engine is not sufficient to meet the peak domestic heat load so that a supplementary burner is also required.

In the DCHP system, space considerations are paramount. The present invention therefore aims to provide a design of heat exchanger which is able to recover heat from the exhaust gas of the Stirling engine, and also from a supplementary burner which is compact.

According to the present invention there is provided a heating arrangement for heating a fluid, the arrangement comprising an elongate housing having a main axis, an inner chamber for a first fluid surrounding the axis, a plurality of axially extending fins projecting into the inner chamber; an exhaust gas inlet at one end of the inner chamber; a supplementary burner at the opposite end of the chamber arranged to fire radially outwardly onto the fins; and an outer chamber for a second fluid surrounding the inner chamber.

Such an arrangement can be made compact, particularly in view of the arrangement of the first chamber with the exhaust gas inlet at one end and burner at the opposite end. The fins which project into the chamber assist in the absorption of heat from the exhaust gas and the burner and the outer chamber ensures that this absorbed heat is transferred efficiently to the second fluid with little wastage.

In the case of a DCHP system based on the Stirling engine, the exhaust gas inlet is arranged to receive exhaust gas from the Stirling engine, and the second fluid is water which supplies the domestic heating system.

The efficiency of the heat recovery can be increased significantly if the exhaust gas and combustion gas from the supplementary burner are cooled to a temperature below the dew point of the gas. Under these circumstances, the water vapour from the combustion processes will condense and give up a significant amount of latent heat. Therefore, the arrangement of the present invention is preferably provided with a condensate outlet for condensate from the exhaust gas and combustion gas from the burner.

According to another preferred example, the arrangement further comprises a second chamber provided alongside and substantially parallel to the inner chamber, the inner and second chambers being linked at the opposite end so that the flow direction through the second chamber is opposite to the flow direction through the inner chamber, the second chamber having a second plurality of axially extending fins projecting into the second chamber, and the outer chamber also surrounding the second chamber.

Such an arrangement allows the combustion gases to initially pass along the inner chamber where they give up relatively high grade heat to the second fluid, they then pass in the opposite direction through the second chamber where they give up lower grade heat to the second fluid. In this case, the condensate outlet provided, is in the second chamber as it is in this chamber that the temperature of the gases will approach the dew point.

The construction of the heating arrangement of the present invention lends itself particularly to at least the part of the heating arrangement forming the inner chamber and fins being made of aluminium. In practice, the outer chamber can also be aluminium. This has advantages in terms of the manufacturing cost, size and weight. Preferably, at least the part of the arrangement forming the inner chamber and fins is extruded, again helping to reduce the manufacturing cost.

The present invention also extends to the combination of the heating arrangement defined above and a Stirling engine from which exhaust gas is emitted from an exhaust gas outlet, the exhaust gas outlet being connected to the exhaust gas inlet of the heating arrangement. With such a combination, the Stirling engine may be arranged with its hot end uppermost and the heating arrangement being positioned directly above the Stirling engine as this will provide a compact structure. If the heating arrangement with the second chamber is provided, this will be adjacent to the inner chamber, such that the exhaust gas from the Stirling engine will flow upwardly through the inner chamber and downwardly through the outer chamber.

Alternatively, the Stirling engine may be arranged with its hot end lowermost, in which case the heating arrangement is positioned directly below the Stirling engine. In this case, it may be sufficient only to use the heating arrangement with the inner chamber, as the condensate outlet can be positioned at the bottom of the inner chamber.

Examples of the heating arrangement in combination with a Stirling engine will now be described with reference to the accompanying drawings, in which.

Figure 1:
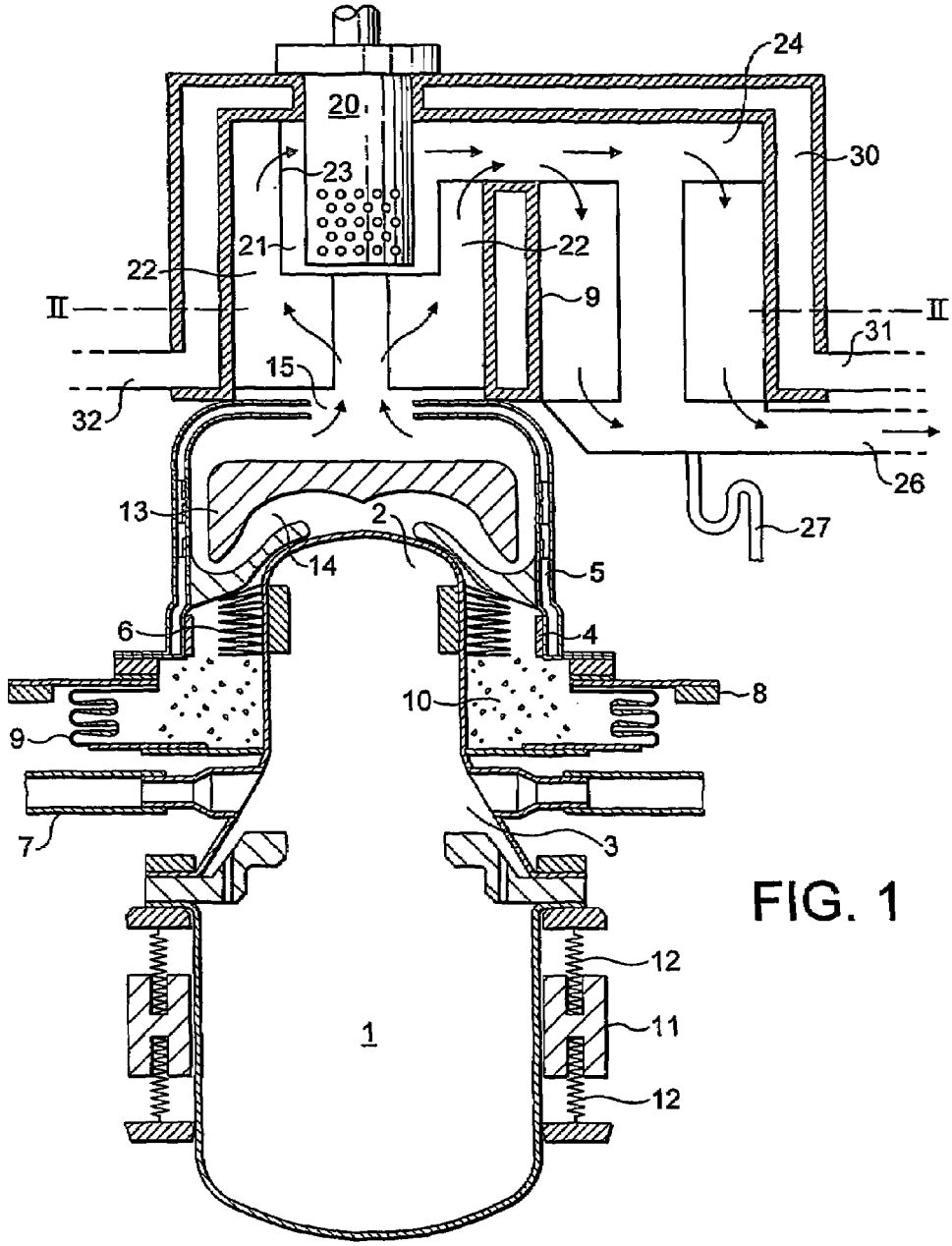
FIG. 1 is a schematic cross-section through a Stirling engine and heating arrangement according to the first example of the present invention.

The arrangement shown in FIG. 1 is based around a linear free piston Stirling engine 1. It has a hot end 2, a cooler 3 and an alternator which generates electrical power output. The hot end is heated by an annular burner 4 which is supplied with combustion gas along combustion gas supply line 5 and is directed towards annular fins 6 which surround the hot end 2 of the engine to assist in the heat transfer to the hot end. The cooler 3 is cooled by a supply of cold water 7 which may be water from the domestic heating system which has given up its heat to the domestic environment and is hence at the lowest temperature in its cycle.

The Stirling engine 1 is supported on bracket 8 via a bellows seal 9 which also serves to provide a seal for the combustion gases from the burner 4 (this is described in detail in GB 0210929.6). The space between the burner 4 and bellows seal 9 is filled with an insulated material 10, an annular mass 11 suspended from the Stirling engine 1 by a plurality of springs 12 to absorb most of the vibrations which will occur in the Stirling engine 1.

Exhaust gases from the burner 4 flows around baffle 13 along exhaust gas path 14 to exhaust gas outlet 15.

As described so far, the features of the Stirling engine are generally known in the art. A detailed description will not be provided here. It should also be understood that alternative engine arrangements may be used with the context of the present invention as the only requirements for the heating arrangement is that it receives a supply of exhaust gas from some source.

The heating arrangement of FIG. 1 will now be described.

As well as receiving exhaust gas from the exhaust gas outlet 15, the heating arrangement has a second source of heat in the form of a supplementary burner 20 which is generally coaxial with the Stirling engine 1.

Figure 2:
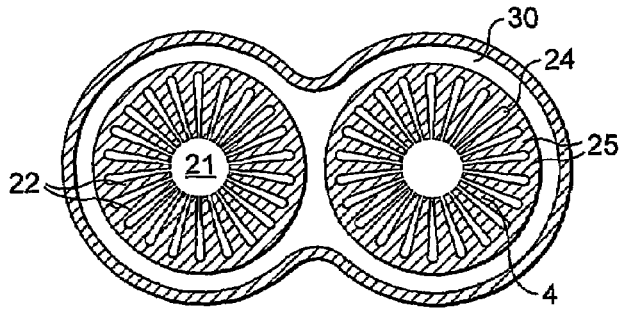
FIG. 2 is a cross-section through line II-II of FIG. 1.

The heating arrangement comprises a cylindrical inner chamber 21 into which a plurality of fins 22 extend from the outer wall. Each fin 22 is positioned in a generally radial plane, but is tapered in the radially inward direction as best shown in FIG. 2. Also, as shown in FIG. 1, each fin has a cut-out portion 23 to accommodate the supplementary burner 20 giving each fin a substantially L-shape.

As will be appreciated from FIG. 1, the exhaust gas from the Stirling engine enters the bottom end of the inner chamber 21 and flows upwardly over the widest part of the fins which absorb heat from the exhaust gas.

The supplementary burner 20 fires radially outwardly on to the upper part of the fins 22. The combined combustion gas stream flows upwardly towards the top of the inner chamber and passes out of the inner chamber at the top right hand corner of the inner chamber as shown in FIG. 1 where it flows across into second chamber 24. The second chamber 24 is provided with a plurality of fins 25 which project radially inwardly from the wall of the second chamber in a similar manner to the fins 22 in the inner chamber 21. The only difference between the two sets of fins is that the fins 25 in the second chamber 24 do not have the cut-out portion.

The combustion stream flows downwardly through the second chamber and further heat is absorbed into the fins 25. At the base of the second chamber, the now cool combustion products enter a manifold 26 and are led along a suitable duct (not shown) to the flue of the appliance. In this manifold 26, any water that is condensed in the second chamber 24 will be collected and passes through a syphon trap 27 into a drain (not shown).

The inner chamber 21 and second chamber 24 are surrounded at their side and top surfaces by an outer chamber 30 through which water is arranged to pass from inlet 31 to outlet 32. This water receives the heat which has been absorbed by the first 21 and second 24 chambers and, in particular, the fins 22, 25. This water then supplies the domestic heat load. It should be noted that this water can also be part of the same circuit as the water supply 7 which cools the cooler 3 of the Stirling engine.

Figure 3:
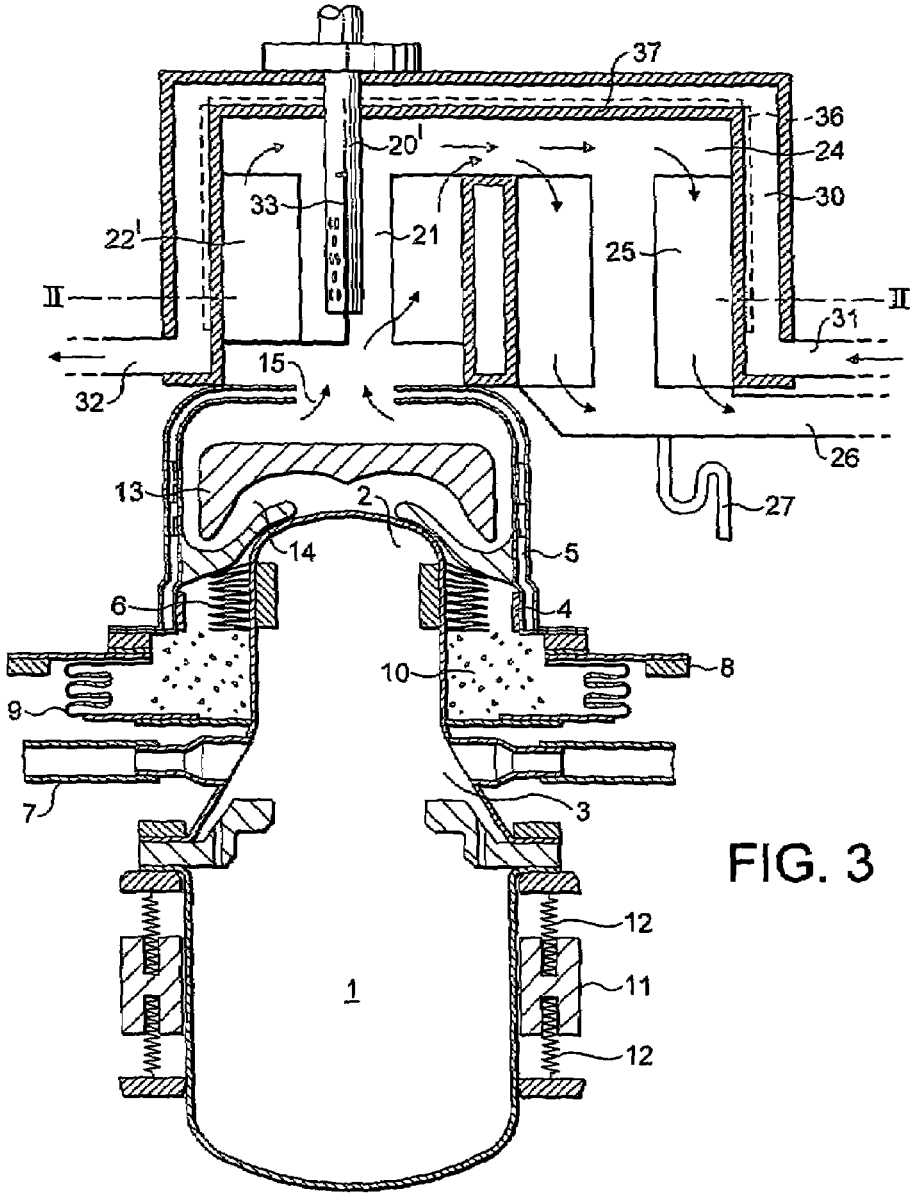
FIG. 3 is a schematic cross-section similar to FIG. 1 showing a second example.
Figure 4:
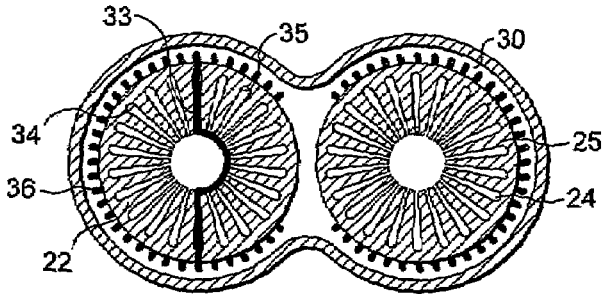
FIG. 4 is a cross-section through line IV-IV in FIG. 3.

A second example is shown in FIGS. 3 and 4. This is the same, in most respects, as the example of FIGS. 1 and 2 and the same reference numerals have been used to designate the same components. However, the design of the supplementary burner 20' and fins 22' has been modified. In this case, the supplementary burner 20' extends along most of the length of the inner chamber 21. The fins therefore do not have the L-shape cut out of FIG. 1. A baffle 33 as best shown in FIG. 4 is provided to separate the inner chamber 21 into a burner chamber 34 on the left hand side of the baffle 33 in FIGS. 3 and 4 and an exhaust gas chamber 35 on the right hand side of the baffle 33 in FIGS. 3 and 4. The supplementary burner fires only into the burner chamber 34, while the exhaust gas passes only through the exhaust gas chamber 35. Thus, the two streams are prevented from mixing until they have given up their heat within the inner chamber 21. This design is useful in overcoming disruption to combustion within the supplementary burner due to pressure fluctuations leading from the engine burner chamber.

Also shown in FIGS. 3 and 4 are a number of axially extending fins 36 on the outside of the inner chamber 21 and second chamber 24 and a further plurality of fins 37 running across the top of the inner chamber 21 and second chamber 24. These are designed to increase the heat transfer area. An alternative fin design would be one or more spiral fins wound around the outer surface of each chamber 21 and 24, which may provide advantageous flow characteristics within the passage. These arrangements could, of course, be applied to the examples of FIGS. 1 and 2.

Figure 5:
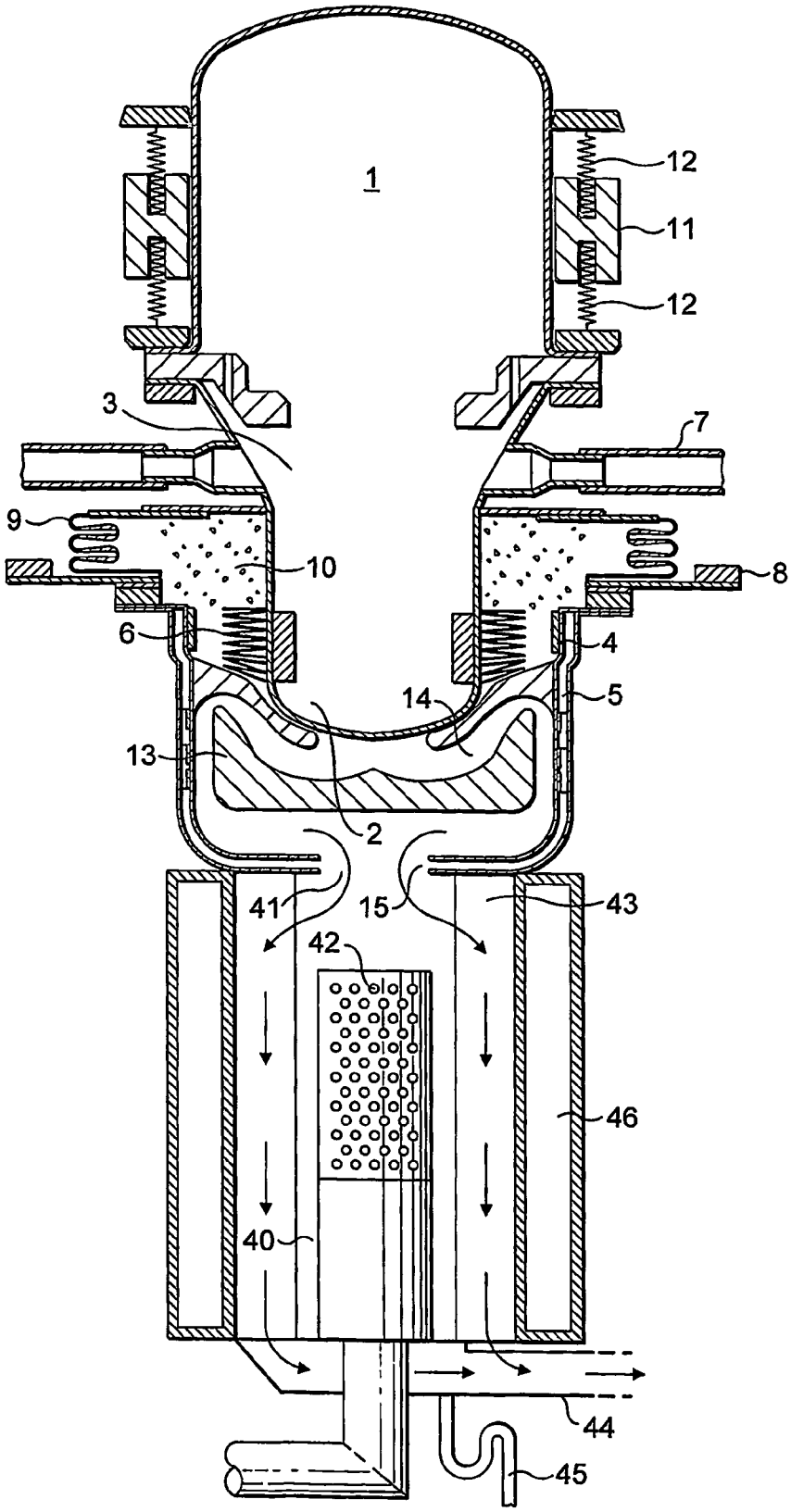
FIG. 5 is a schematic cross-section through an inverted Stirling engine and heating arrangement according to a third example.

A third example is shown in FIG. 5. FIG. 5 shows the Stirling engine 1 and its associated components in inverted configuration, i.e. with the hot end 2 lowermost. Otherwise, the components of the Stirling engine are the same as those shown in FIG. 1 and the same reference numerals have been used to designate the same components. Again, it should be understood that any engine configuration can be used, provided that it produces a downward flow of hot exhaust gas at its lower end.

The heating arrangement 1 has the same general construction as FIG. 1, the main differences being that it is also of inverted configuration, and has only a single inner chamber 40 in place of the inner chamber 21 and second chamber 24 of FIG. 1.

Essentially, the inner chamber 40 is arranged with an exhaust gas inlet 41 uppermost to receive exhaust gas from the Stirling engine exhaust gas outlet 15. The supplementary burner 42 is inserted through the bottom of the inner chamber 40. The inner chamber 40 has a plurality of radially inwardly extending fins 43 which have generally the same construction as the fins 22, 25 shown in FIG. 2 (and may also have outwardly extending fins as shown in FIGS. 3 and 4). However, as the supplementary burner 42 projects to a greater axial extent than the supplementary burner 20 of FIG. 1, the fins do not have a cut-out portion and have a uniform cross-section along their lengths, albeit one which is radially shorter than the fins shown in FIG. 2.

These fins 43 absorb heat from the exhaust gas from the Stirling engine and also from the burner which fires outwardly directly on to the fins. The combined combustion gases flow downwardly to a base manifold 44 before being led in a suitable duct (not shown) to the flue of the appliance. As with FIG. 1, a syphon trap 45 receives any condensate which collects in the manifold 44. An outer chamber 46 surrounds the inner chamber 40 and receives heat absorbed by the first chamber 40 and fins 43 as described above with reference to FIG. 1.

The invention claimed is:

1. A heating arrangement for heating a fluid, the arrangement comprising an elongate housing having a main axis, an inner chamber for a first fluid surrounding the axis, a plurality of axially extending fins projecting into the inner chamber; an exhaust gas inlet at one end of the inner chamber; a supplementary burner extending from the opposite end of the chamber arranged to fire radially outwardly on to the fins; and an outer chamber for a second fluid surrounding the inner chamber.

2. An arrangement according to claim 1, wherein a condensate outlet is provided for condensate from the exhaust gas from the inlet and combustion gas from the burner.

3. An arrangement according to claim 1, wherein a second chamber is provided alongside and substantially parallel to the inner chamber, the inner and second chambers being linked at the opposite ends so that the flow direction through the second chamber is opposite to the flow direction through the inner chamber, a second plurality of axially extending fins projecting into the second chamber, and the outer chamber also surrounding the second chamber.

4. An arrangement according to claim 3, wherein the condensate outlet is provided in the second chamber.

5. An arrangement according to claim 1, wherein at least the part of the arrangement forming the inner chamber and fins is made of aluminium.

6. An arrangement according to claim 1, wherein at least the part of the arrangement forming the inner chamber and fins is extruded.

7. A combination of an arrangement according to claim 1 and a Stirling engine from which exhaust gas is emitted from an exhaust gas outlet, the exhaust gas outlet being connected to the exhaust gas inlet of the heating arrangement.

8. A combination according to claim 7, wherein the Stirling engine has a hot end, and is arranged with its hot end uppermost, the heating arrangement being positioned directly above the Stirling engine.

9. A combination according to claim 7, wherein the Stirling engine has a hot end and is arranged with its hot end lowermost, the heating arrangement being positioned directly below the Stirling engine.

* * * * *